United States Patent [19]

Boecker et al.

[11] Patent Number: 5,056,665

[45] Date of Patent: Oct. 15, 1991

[54] SUSPENSION PACKAGE

[75] Inventors: Mark E. Boecker, Beecher; Michael T. McGrath, Channahon, both of Ill.; Joseph Grygny, Milwaukee, Wis.

[73] Assignee: ADE, Inc., Chicago, Ill.

[21] Appl. No.: 539,798

[22] Filed: Jun. 18, 1990

[51] Int. Cl.[5] ..... B65D 81/02

[52] U.S. Cl. ..... 206/583

[58] Field of Search ..... 206/583

[56] References Cited

U.S. PATENT DOCUMENTS

| | | | |
|---|---|---|---|
| 2,501,570 | 8/1946 | Larsen . | |
| 2,596,244 | 7/1951 | Jacket . | |
| 2,681,142 | 11/1950 | Cohen . | |
| 2,700,460 | 10/1951 | Hoover . | |
| 2,700,518 | 1/1955 | Ryno et al. | 206/583 |
| 2,735,543 | 2/1956 | Trow . | |
| 2,771,184 | 11/1956 | Ryno et al. | 206/583 |
| 2,785,795 | 3/1957 | Ryno et al. | 206/583 |
| 2,811,246 | 5/1954 | Sloane | 206/583 |
| 2,837,208 | 4/1956 | Lingenfelter | 206/583 |
| 2,956,672 | 12/1958 | Kirkpatrick . | |
| 3,136,641 | 2/1961 | Hall . | |
| 3,463,309 | 8/1969 | Szostek . | |
| 3,521,743 | 7/1970 | Sposito . | |
| 3,552,595 | 1/1971 | Gerner . | |
| 3,692,264 | 9/1972 | Burkhard et al. . | |
| 3,752,301 | 8/1973 | Bluemel | 206/583 |
| 3,853,220 | 12/1974 | Luray | 206/583 |
| 3,857,487 | 12/1974 | Misslin . | |
| 3,876,812 | 4/1975 | Peters . | |
| 4,319,684 | 3/1982 | Backman et al. . | |
| 4,606,459 | 8/1986 | Luray | 206/583 |
| 4,606,460 | 8/1986 | Luray | 206/583 |

FOREIGN PATENT DOCUMENTS

| | | | |
|---|---|---|---|
| 2723-175 | 11/1978 | Fed. Rep. of Germany | 206/583 |
| 53-135796 | 11/1978 | Japan . | |
| WO83/02932 | 9/1983 | PCT Int'l Appl. . | |
| 827346 | 1/1979 | U.S.S.R. | 206/583 |
| 237322 | 7/1925 | United Kingdom | 206/583 |

*Primary Examiner*—William I. Price

*Attorney, Agent, or Firm*—Willian Brinks Olds Hofer Gilson & Lione

[57] ABSTRACT

A suspension package of the type having a frame and a hammock tensioned across the frame to enfold and support a product is provided with a brace to prevent the ends of the frame from moving inwardly. This brace simultaneously provides a safety net to protect the product being loaded into the hammock. The hammock is secured to tensor flaps on the frame, and these flaps are provided with tabs whcih prevent the flaps from rotating inwardly past the plane of the end panels. The hammock is folded in a double fan fold at its ends to facilitate top loading and to accommodate the widest range of product sizes and shapes. Each of the tensor flaps has an inner part and an outer part, and the hammock end is sandwiched between the inner and outer parts and held in place by a double ended rivet which simultaneously operates to secure the tensor flaps in the hammock tensioning position. Cinching devices are used around the hammock to center the product within the frame. Lifting slots and handles are disclosed for facilitating removal of the frame from a container.

26 Claims, 6 Drawing Sheets

114
116
110
112
18
60
P
18
14
57
57
82
59
22
74
20
72
10
70
112
16
116
110
76
80
32
34
36
114
12

FIG. 7G
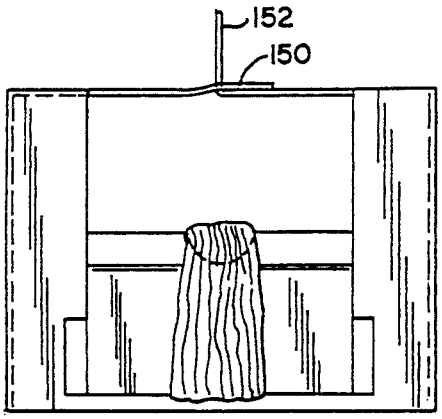
FIG. 9A
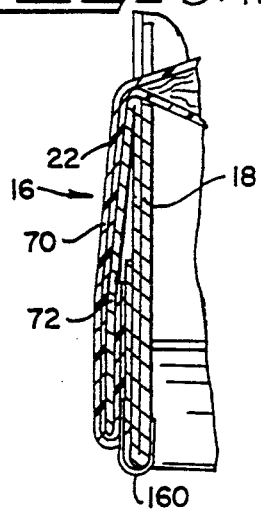
FIG. 6A
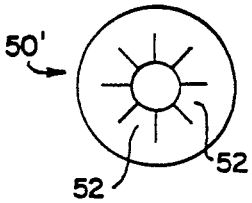
FIG. 6B
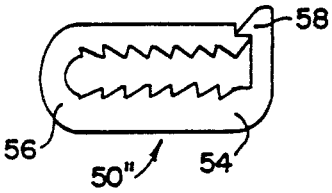
FIG. 6C
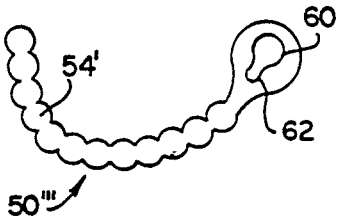
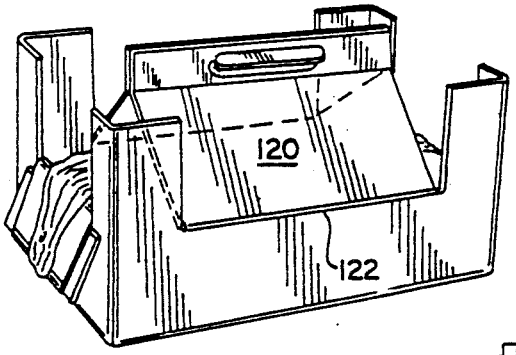
FIG. 7C
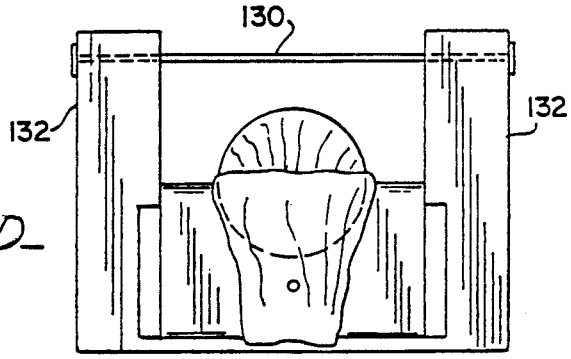
FIG. 7D

SUSPENSION PACKAGE

BACKGROUND OF THE INVENTION

The present invention relates to an improved suspension package of the type comprising a frame and a hammock stretched across the frame to suspend and protect a product, and in particular to such a suspension package which is readily packed and unpacked with the product to be protected, and which provides excellent protection to the product.

Suspension packages of the general type described above are well known in the art. Luray U.S. Pat. Nos. 4,606,460, 4,606,459 and 3,853,220 (all assigned to the assignee of the present invention) disclose several effective suspension packages. As disclosed in the Luray patents, the product to be protected is enclosed in a hammock which is in turn connected at each of its ends to a respective panel pivotably mounted to a frame. When the panels are pivoted outwardly, the hammock is tensioned and the product within the hammock is suspended within the frame. The frame can be enclosed within a separate container, or alternately the frame itself may form part of a container.

The primary object of this invention is to provide an improved suspension package, which may be of the general type shown in the Luray patents, which is easier to use and manufacture, and which provides an improved degree of protection to the packaged product.

SUMMARY OF THE INVENTION

As will become apparent from the following detailed description, this invention is directed to a number of improvements to the conventional suspension package. Though these improvements are preferably used in combination, each can be used separately, and each has independent utility. They can be grouped into the five areas discussed below.

It has been discovered that without proper bracing the end panels of the frame can bend or kink in use, thereby removing tension from the hammock and allowing the packaged product to be damaged. A first aspect of this invention relates to a bracing means that is coupled to the end panels of the frame to prevent the end panels from moving inwardly in response to tensile forces applied to the end panels by the hammock. This first aspect of the invention substantially overcomes problems related to bending of the end panels, and it additionally preferably provides a safety net under the hammock which protects a product from damage should it be inadvertently dropped as it is being inserted into or removed from the hammock. The frame is preferably collapsible for storage prior to use, and the bracing means preferably does not interfere with the collapsibility of the frame.

A second aspect of this invention addresses the problem that the product can shift axially along the length of the hammock during shipment. If the product reaches one extreme end of the hammock, it is subject to damage. In order to overcome this problem, the present invention provides a cinching device to restrict lateral spreading of the hammock, and to improve centering of the product within the hammock. This cinching device provides the further advantage that a given frame and hammock can be used with a range of products differing substantially in length. The cinching device reduces any undue motion of a small product in a relatively large hammock.

A third aspect of this invention addresses the problem that the hammock may be relatively difficult to load and unload with the product, particularly by untrained personnel. In order to improve the ease of loading and unloading, the present invention provides means for preventing the flaps to which the hammock ends are secured from pivoting inwardly beyond a selected position. By preventing the flaps from pivoting inwardly excessively, the hammock is maintained in a position in which it is easily loaded.

Another aspect of this invention that improves the ease of loading is that the hammock is preferably folded in a double fan fold which leaves the opening to the hammock centered at the upper portion of the hammock, yet which tapers the ends of the hammock in a neat, folded pattern to facilitate attachment of the ends of the hammock to the frame. This arrangement for the hammock also provides a bellows-type expandibility to the hammock, and enhances the ability of the hammock to accommodate products of widely varying sizes.

Another potential problem with the prior art relates to the manner in which the hammock is secured to the frame. In the past various adhesives and spike arrangements have been suggested. Adhesives may fail, and spikes provide high localized loading on the hammock. In order to ensure that the hammock will not work loose from the frame, the present invention provides an improved arrangement for securing the hammock to the frame in which the ends of the hammock are held in place between two panels. The panels grip the hammock and spread the holding forces to reduce localized forces on the hammock. A two ended fastener may be used both to secure the two panels together and to secure the tensioning panel in the hammock tensioning position. The embodiments described below have all of the advantages of a pre-attached hammock (i.e., they are easy to use and the length of the hammock can be precisely controlled) yet still be collapsed for storage prior to use.

A sixth aspect of this invention improves the ease with which a recipient of the suspension package may remove the frame from the container. Persons unfamiliar with suspension packages may not immediately understand that the frame is to be removed from the container before the product can be removed from the hammock. There is a tendency to grasp the product directly and to pull on the product or the hammock. This approach is generally counter-productive, because increased tension on the hammock tends to wedge the frame in the container. In order to overcome this problem this invention provides an improved frame having means, independent of the hammock, for lifting the frame from the container. This lifting means may include means for spanning the sides of the frame over the hammock and providing graspable surfaces. To some extent, this arrangement hides the hammock and the product from view. The spanning means is preferably printed with instructions for the user, indicating that the spanning means is to be lifted to remove the frame from the container. The spanning means may include a handle to facilitate such lifting.

When these six features of the invention are used together, they provide a remarkably improved suspension package which can be loaded and unloaded easily, and which provides excellent protection to the suspended product. Additionally, a conventional suspension package can be improved using any one or more of these features.

The invention itself, together with further objects and attendant advantages, will best be understood by reference to the following detailed description, taken in conjunction with the accompanying drawings.

Figure 4:
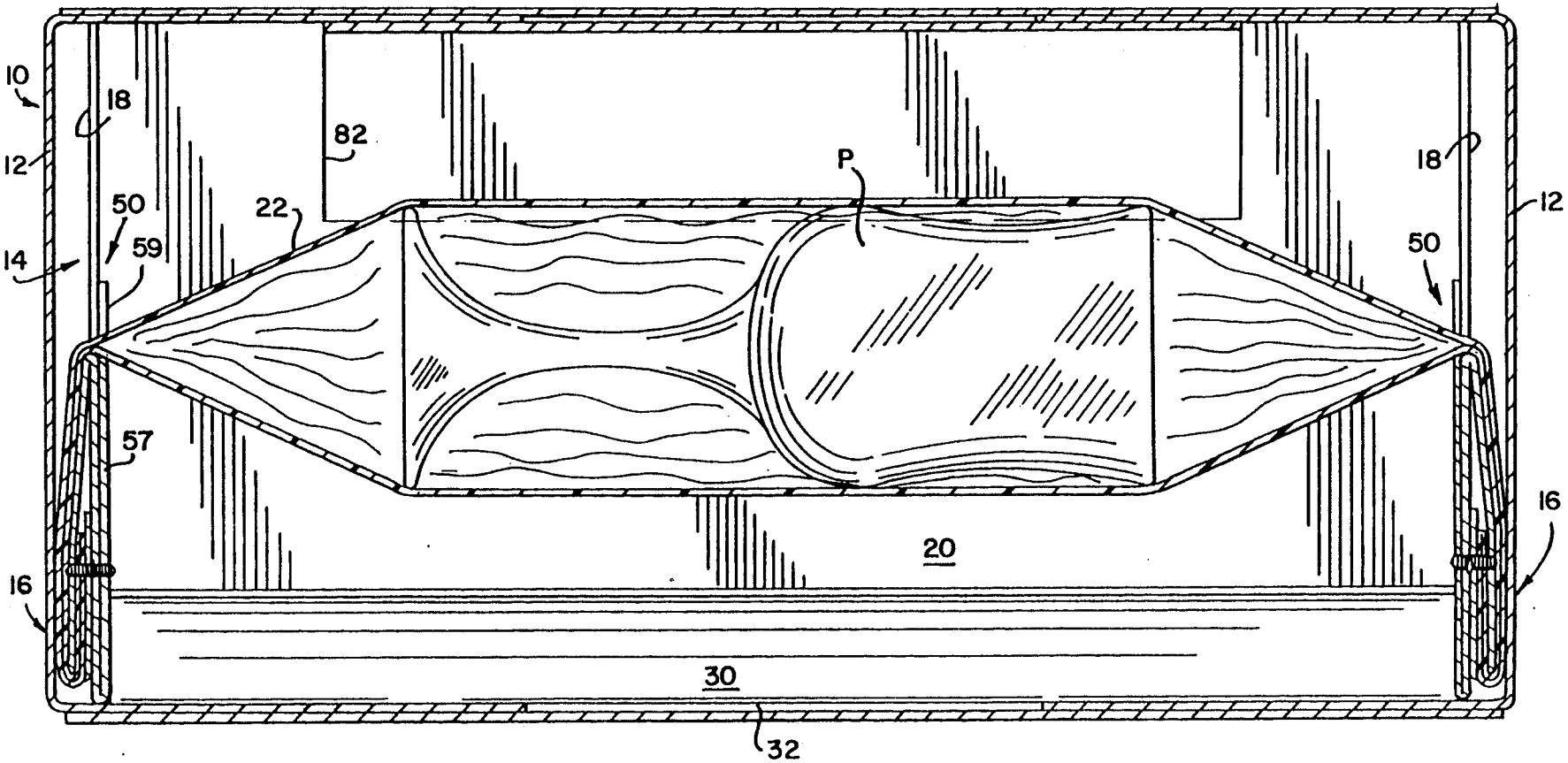
FIG. 4 is a longitudinal sectional view taken along line 4—4 of FIG. 2.

FIGS. *5a*, *5b* and *5c* are cross-sectional views taken in the plane of FIG. 4 showing one of the tensor panels in initial, intermediate and tensioned positions, respectively.

Figure 1:
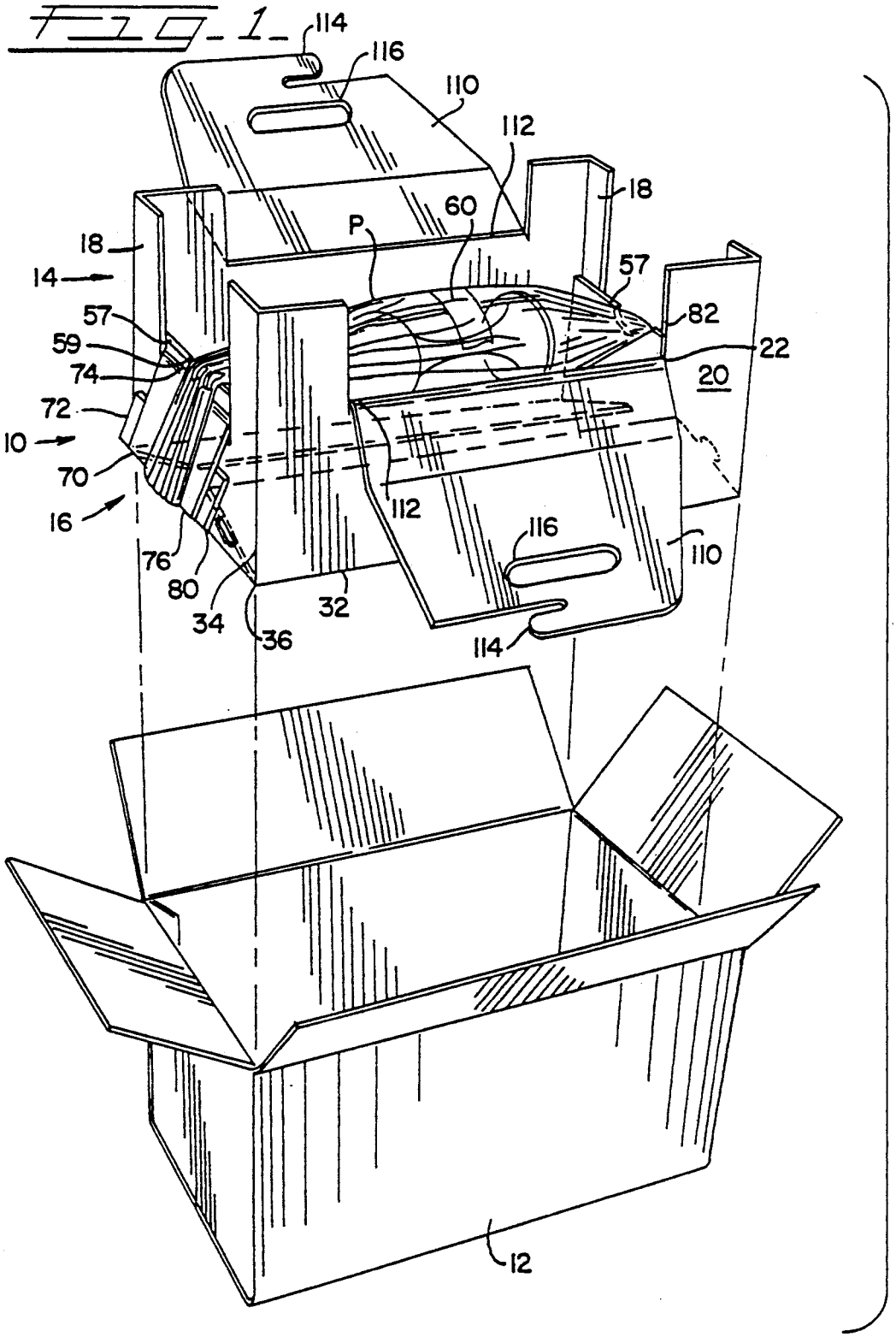
FIG. 1 is an exploded perspective view of a suspension package which incorporates a first preferred embodiment of this invention.
Figure 2:
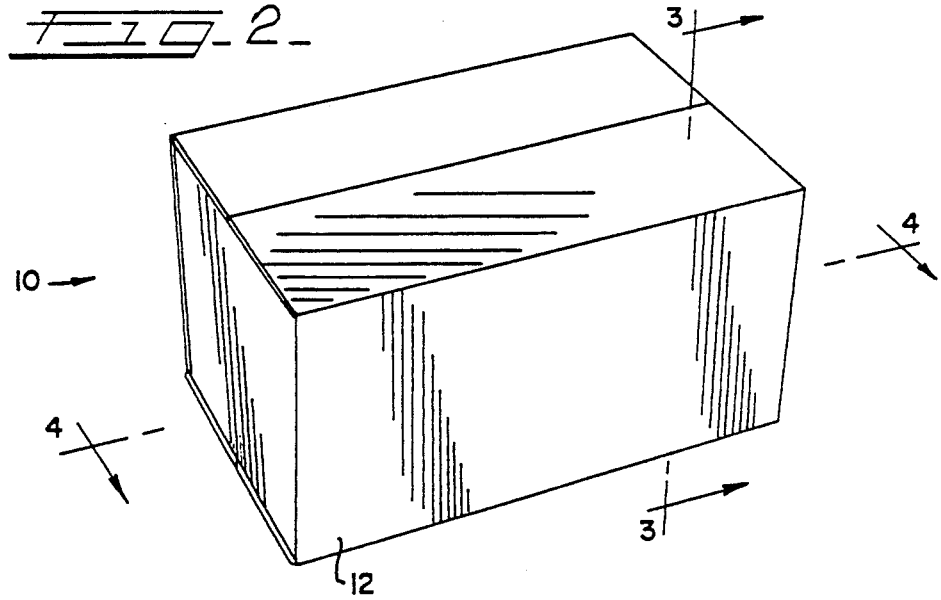
FIG. 2 is a perspective view of the assembled embodiment of FIG. 1.

FIGS. *6a*–*6c* show three alternative cinching devices suitable for use in the embodiment of FIG. 1.

FIG. *7a* is an end view of the frame of FIG. 1.

FIG. *7b* is a top view of the frame of FIG. *7a*.

FIG. *7c* is a perspective view of a frame of a second preferred embodiment of this invention.

FIG. *7d* is an end view of a frame of a third preferred embodiment of this invention.

FIG. *7e* is an end view of a frame of a fourth preferred embodiment of this invention.

FIG. *7f* is a top view of the frame of FIG. *7e*.

FIG. *7g* is an end view of a frame of a fifth preferred embodiment of this invention.

Figure 3:
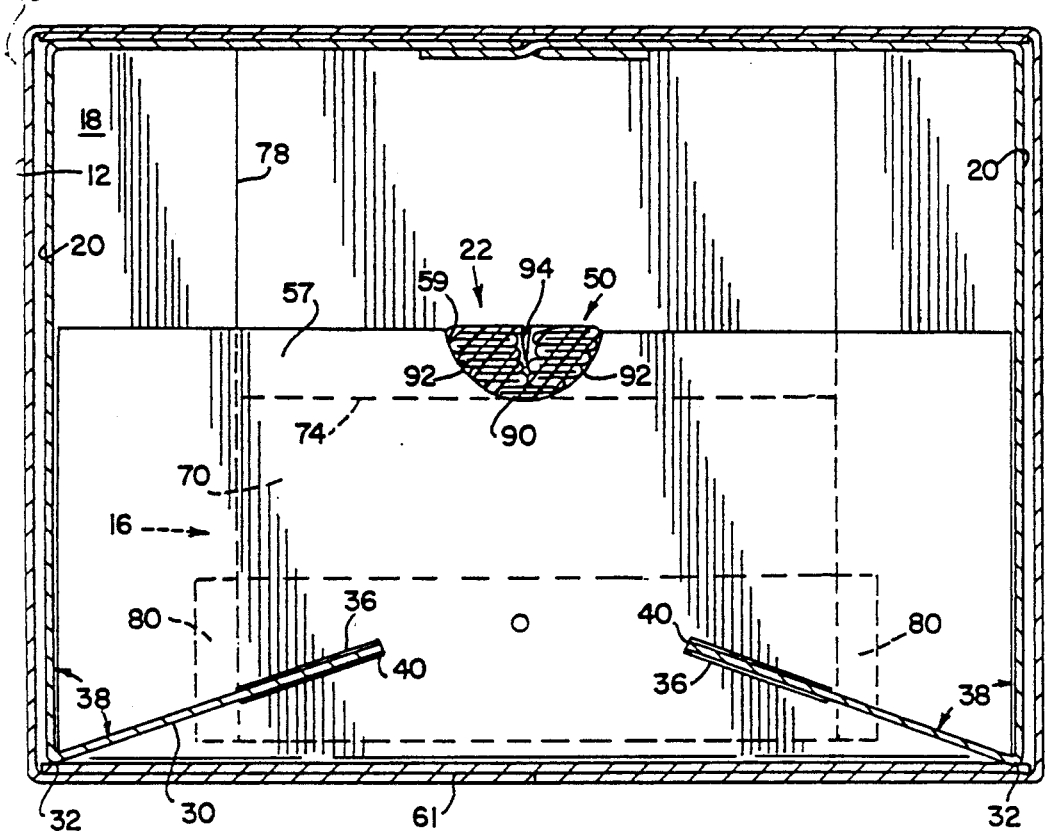
FIG. 3 is a cross-sectional view taken along line 3—3 of FIG. 2.

FIG. *8a* is a cross-sectional view taken in the plane of FIG. 3 of a sixth preferred embodiment of this invention.

FIG. *8b* is a perspective view of a tubular strut included in the embodiment of FIG. *8a*.

FIG. 9 is a cross sectional view of a seventh preferred embodiment of this invention.

DETAILED DESCRIPTION OF THE PRESENTLY PREFERRED EMBODIMENTS

Referring to the drawings, FIGS. 1–*5c* and *7a*–*7b* show various views of a first preferred embodiment 10 of the suspension package of this invention. This suspension package 10 includes a container 12 which may be a six-sided container as shown in FIG. 1. It should be understood that other types of containers may be suitable for other embodiments of this invention, including four-sided sleeves. Furthermore, some applications for this invention do not require containers at all.

Returning to FIG. 1, the container 12 is sized to receive a frame 14. In this embodiment, the frame 14 is folded from a corrugated paperboard, and the frame 14 includes a pair of tensor flaps 16. Each of the tensor flaps 16 is hinged at a fold line to a respective one of the end panels 18 of the frame 14. The end panels 18 are interconnected by side panels 20, and the panels 18, 20 form a four-sided sleeve. In alternate embodiments, a single container may be sized to receive multiple frames.

A hammock 22 is secured at each end to one of the tensor flaps 16, and the hammock 22 is dimensioned to retain a product P. When the tensor flaps 16 are pivoted inwardly, toward one another (FIGS. *5a*, *5b*), tension on the hammock 22 is released and the product P can be inserted into or removed from the hammock 22. When the tensor flaps 16 are pivoted outwardly to the position shown in FIGS. 1 and *5c*, the hammock 22 is tensioned, and the product P is suspended within the frame 14 and protected from shock and vibration. In alternate embodiments, a single frame may support multiple hammocks The above-described features of the container 12 and frame 14 do not per se form part of this invention, and are described in the above-identified Luray patents. As pointed out above, the present invention is directed to a number of improvements to the basic suspension package described above. These improvements will be described in detail in the following sections.

Bracing Means For End Panels

As mentioned above, the hammock 22 is tensioned between the end panels 18 in use. If the product P is particularly heavy or large for the hammock 22, or if the hammock 22 is particularly short for the frame 14, or if the container 10 is subjected to excessive acceleration, tension on the hammock 22 will tend to cause the end panels 18 to move toward one another. Should one of the end panels 18 crease or crack, the end panel 18 may move inwardly, removing tension from the hammock 22 and allowing the product P to come into contact with the side panels 20 or the container 12.

In order to prevent such a failure, the frame 10 includes means for bracing the end panels 18 against inward movement to prevent the end panels 18 from bending or buckling in use. This bracing means allows the frame 14 to function reliably with a wide range of product sizes and weights. In the frame 14, this bracing means comprises a pair of struts 30. Each of the struts 30 is integrally joined with a respective one of the side panels 20 at a fold line 32. Each of the struts 30 defines at each end a respective tab 34, and each of the end panels 18 defines a matching pair of slots 36 (FIGS. 1 and 3).

Prior to use, the frame 14 can be folded flat, with the struts 30 coplanar with the respective side panels 20. When the frame 14 is unfolded to the position of FIG. 1, the struts 30 are bent inwardly along the fold lines 32 to cause the tabs 34 to engage the slots 36. In this position, the struts 30 define with the adjacent side panels 20 an included angle 38, and this included angle is preferably acute. This causes the innermost edges 40 of the struts 30 to extend upwardly from the base of the end panels 18 in the region under the hammock 22.

In this position, the struts 30 perform three important functions. First, the struts 30 extend between the end panels 18 and brace the end panels 18 against inward movement. In this way, any tendency of the end panels 18 to move inwardly and to relax tension on the hammock 22 is substantially eliminated. Second, the struts 30 hold the frame 14 in a rectangular configuration, in which the end panels 18 are perpendicular to the side panels 20. This overcomes any tendency of the frame 14 to fold back into a flattened configuration, and provides a stable frame 14 when the hammock 22 is being loaded with the product P prior to insertion of the frame 14 into the container 12. Third, the innermost edges 40 of the struts 30 extend under the hammock 22, and are spaced above the lower edge of the end panels 18. For this reason, the struts 30 provide a safety net to arrest the product P if it is inadvertently dropped while being loaded into or removed from the hammock 22. In this way the product P is maintained out of contact with the surface on which the frame 14 is positioned, and the product P is protected against damage. All of these advantages are obtained without increasing the number of separate parts, and without interfering with the ability of the frame 14 to fold flat for shipment and storage prior to use.

Figure 8A:
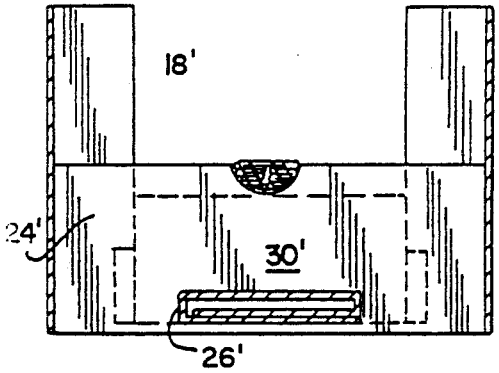
Figure 8B:
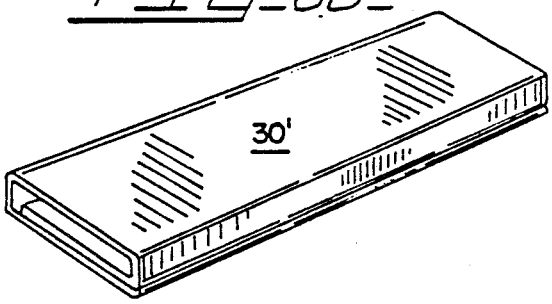

It is not essential in all embodiments that the struts 30 be secured to the side panels 20. FIGS. 8*a* and 8*b* show an alternate embodiment which includes a single, central tubular strut 30'. In this alternate embodiment, the end panel 18' includes a lower flap 24' which during assembly is folded upwardly to the inside of the end panel 18' to the position shown in FIG. 8*a*. The lower flap 24' defines a cutout 26' sized to receive the end of the strut 30'. In this embodiment, the strut 30' is rectangular in cross-section and is formed from a piece of corrugated paperboard. Such a design for the strut allows it to be folded flat for shipment, separately from the end panel 18'. Of course, alternate tubular configurations are possible for the strut 30', including circular cross sections.

Furthermore, other arrangements are possible for the strut or struts used to brace the end panels, and in some applications it may be preferable to have such struts affixed to the end panels, or extending across the corners between the end panels and the side panels. As pointed out above, struts can either be formed as an integral part of the frame, or they can be shipped separately from the frame prior to final assembly.

Cinching Device

As pointed out above, the product P can shift axially in the hammock 22, particularly if the product P is substantially shorter in length than the hammock 22. In order to overcome this problem and to allow the hammock 22 to be used with both short and long products P, the embodiment of FIGS. 1–5*c* includes a pair of cinching devices 50 (FIGS. 3 and 4). These cinching devices 50 confine the lateral spread of the hammock 22 in order to restrict axial movement of the product P and to improve centering of the product P in the frame 14.

The cinching devices shown in FIGS. 3 and 4 each include a panel 57 that defines a U-shaped notch 59 at its upper edge. The lower edge 61 of the panel 57 is integrally joined to the bottom of the end panel 18 at a fold line. The U-shaped notch 59 confines the hammock 22 laterally and enhances the ability of the hammock to function with products that vary substantially in size.

In the conventional manner, a snugging device 60 such as the tape shown in FIG. 1 is used to close the hammock 22 around the product P. Alternately, cinches, belts and elastic straps can be used in substitution for the tape 60. Similarly, hook and loop fasteners can be adapted for use as a snugging device.

FIG. 6*a* shows an alternate cinching device 50' which includes directionally selective means for allowing the cinching device 50' to move toward the product P, while preventing the cinching device from moving away from the product P. This directionally selective means in this embodiment includes a plurality of teeth 52 joined at their outer edges to form an annular structure sized to surround the hammock 22. In use these teeth 52 are directed towards the hammock 22 and away from the product P. The teeth 52 when oriented as described slide over the hammock 22 to allow the cinching device 50' to be moved toward the product P, but will grip the hammock 22 and prevent the cinching devices from moving away from one another. This directionally selective action allows the cinching devices to be moved into position against the product P after it has been inserted into the hammock 22.

Alternate configurations can be used for the cinching device, as shown in FIGS. 6*b* and 6*c*. The cinching device 50'' shown in FIG. 6*b* includes an elongated member 54 which hinges along a hinge axis 56 and can be latched in a closed position by a latch 58. The cinching device 50''' shown in FIG. 6*c* includes an elongated member 54' having a latch 58'. The latch 58' defines a keyhole shaped opening 60 having a reduced portion 62. Once the elongated member 54' is inserted in the keyhole opening 60 around the hammock 22, the elongated member 54' can be moved into the reduced portion 62 to latch the elongated member 54' in place.

Hammock Loading And Unloading Aids

In the suspension packages described in the Luray patents, the tensor flaps are free to fold inwardly. This can result in a hammock that is so loose that it is difficult to load, or that allows the product to come into contact with the surface on which the frame is placed during product loading.

Figure 5A:
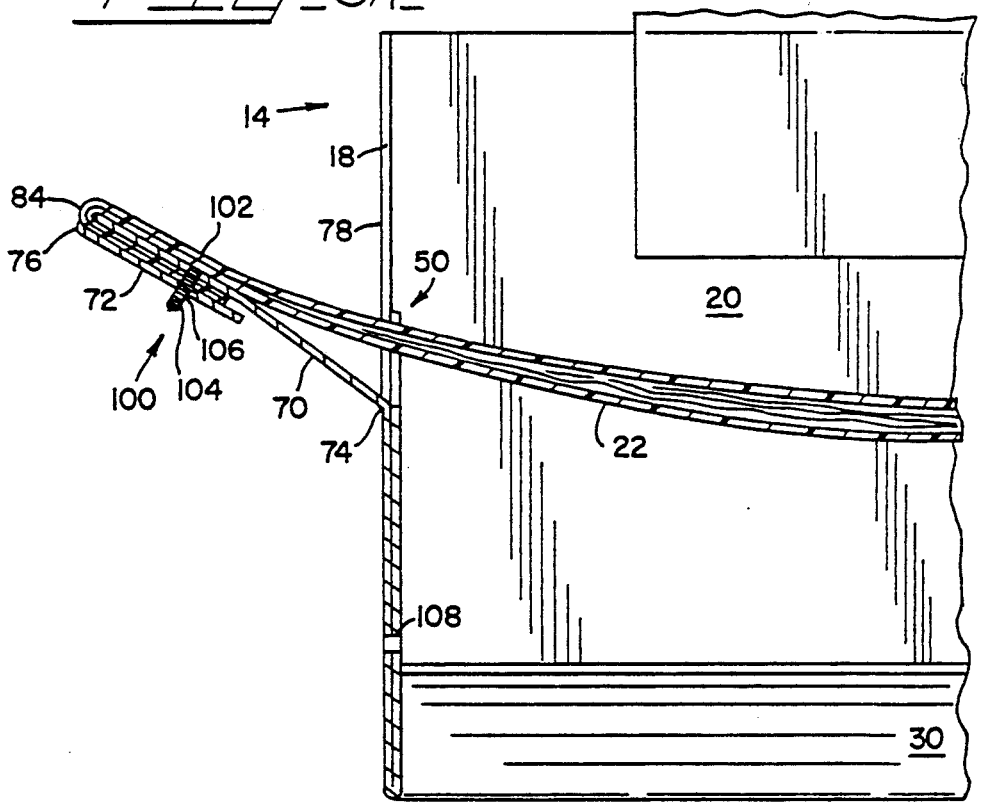
Figure 5B:
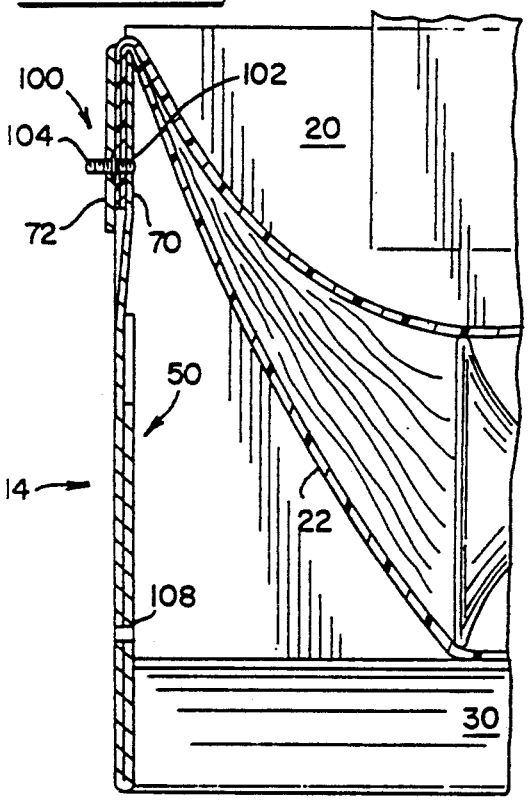
Figure 5C:
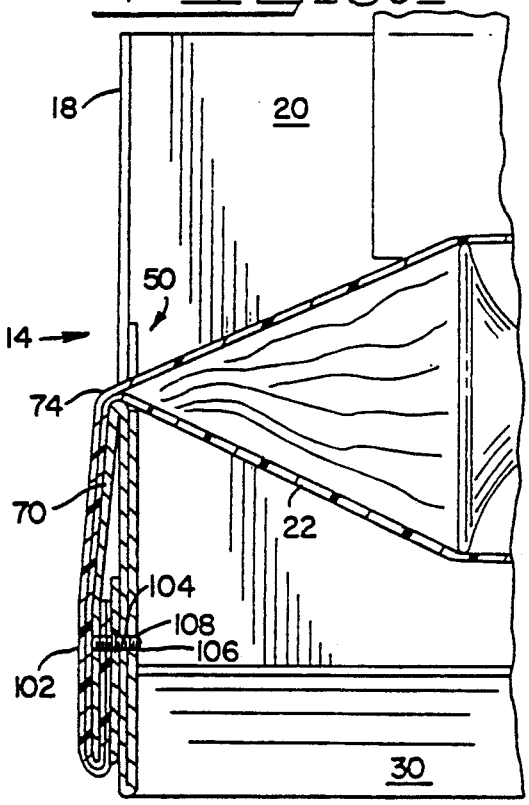

In order to overcome this problem, the frame 14 includes tensor flaps 16, each having an inner portion 70 and an outer portion 72 (FIGS. 5*a*–5*c*). The inner portion 70 is secured to the respective end panel 18 at a fold line 74, and the outer portion 72 is secured to the respective inner portion 70 at a fold line 76. The inner and outer portions 70, 72 cooperate to secure the ends of the hammock 22 between them, as described in detail below.

As best shown in FIG. 1, the inner portion 70 is die cut from the same piece as the end panel 18, and for this reason the width of the inner portion 70 is substantially equal to the width of the notch 78 formed in the end panel 18. The width of the outer portion 72 is greater than the width of the inner portion 70, and the sides of the outer portion 72 form tabs 80. These tabs 80 are dimensioned such that they will not pass through the notch 78, and they prevent the tensor flap 16 from pivoting inwardly beyond the plane defined by the end panel 18. FIG. 3 shows in dotted lines the tabs 80 and clearly shows the spatial relationship between the tabs 80 and the width of the notch 78.

The tabs 80 function as a means for preventing the tensor flaps from pivoting inwardly beyond a selected position. In this selected position the included angle 81 defined between the tensor flaps 16 and the hammock 22 is less than 90 degrees. In alternate embodiments, the selected position could be chosen so that the included angle between the hammock and the tensor flap was greater than 90 degrees but less than about 135 degrees. As another alternative, tabs could be placed on the end panel to restrict inward pivotal movement of the tensor flaps The tabs 80 simplify loading and unloading of the product P as shown in FIGS. 5*a*–5*c*. Initially, the hammock 22 is unloaded, and it assumes a position as shown in FIG. 5*a*. When the product P is loaded into the hammock 22, the weight of the product P may raise the tensor flaps 16 to the position of FIG. 5*b*, where the tabs 80 contact the end panels 18 in the area of the notch 78 and the hammock ends 22 are positioned at their highest position. The tabs 80 hold the hammock 22 in a position that, for the selected hammock length, prevents the product P from striking the surface on which the frame 14 rests. To further assist loading and unloading of the product P, the side panels 20 are provided each with a cut out 82 to allow a hand to be placed under the hammock 22 and the product P being loaded.

In order further to facilitate loading of the product P, the hammock 20 is preferably folded as shown in FIG. 3. The hammock 22 includes a central portion 90, two side portions 92, and two side edges 94 which extend between the two ends of the hammock 22. As shown in FIG. 3, each of the side portions 92 is folded in an array of pleats such that a fan fold or bellows is formed at each of the side portions 92, at least at the ends of the hammock 22. This arrangement allows the hammock 22 to expand to retain large products and yet to function reliably with small products. Additionally, the ends of the hammock 22 can be gathered neatly for attachment to the tensor flap 16 as described below. Furthermore, this arrangement insures that the opening into the interior of the hammock 22 between the side edges 94 is positioned at the upper portion of the hammock 22, extending centrally between the side portions 92. This simplifies top loading of the product P into the hammock 22. As shown in FIG. 1, the hammock 22 is not twisted, but extends in axial pleats between the ends and the product P.

Arrangement For Securing The Hammock To The Tensor Flaps

In order to achieve proper tensioning of the hammock 22, it is preferred to affix the hammock 22 permanently to the tensor flaps 16 with the desired length, while still allowing the frame 14 and the hammock 22 to be folded flat for shipping and storage prior to use. It is essential that the hammock 22 be secured to the tensor flaps 16 in such a way that the hammock 22 will not work or tear loose during use. Preferably, the attachment between the hammock 22 and the tensor flap 16 should be neat in appearance and should avoid high localized stresses on the hammock 22.

According to this invention, each of the tensor flaps 16 is provided with a slot 84 positioned on the fold line 76 between the inner and outer portions 70, 72. One end of the hammock 22 is passed through the slot 84 into the region between the inner and outer portions 70, 72 (FIGS. 5*a*, 5*c*). The inner and outer portions 70, 72 are held together by a double ended fastener 100 having a first end 102 and a second end 104. Each of the ends 102, 104 is provided with ratchet projections 106. The inner and outer portions 70, 72 are provided with aligned openings, and the first end 102 of the fastener 100 is pushed through these openings and through the end of the hammock 22. The ratchet projections 106 insure that the fastener 100 remains in place once assembled.

The fastener 102 clamps the inner and outer portions 70, 72 together and causes the inner and outer portions 70, 72 to grip the hammock 22. In this way, clamping forces are applied over a large area of the hammock 22, and localized tearing forces on the hammock 22 are minimized.

Additionally, the end panels 18 are provided with aligned openings 108 positioned to receive the second ends 104 of the fasteners 100 when the tensor flaps 16 are placed in the hammock tensioning position shown in FIG. 5*b*. In this position the ratchet projections 106 on the second end 104 releasably secure the fastener 100 in the end panel 18, and the tensor flaps 16 are prevented from pivoting inwardly to reduce tension of the hammock 22 when the frame 14 is removed from the container 12. The fasteners 100 thus hold the flaps 16 in the hammock tensioning position.

The preattached hammock 22 should be made of materials selected for specific characteristics such as desired levels of cushioning and strength, and desired anti-static, color, printability and fire retardant characteristics. Suitable materials may include a variety of nets and flexible films made of materials such as PVC, polyurethane, polyethylene, polypropylene, Surlyn, Tyvec, and other similar materials. The size of the hammock 22 is determined by the size of the frame 14 to ensure that the hammock is sized to fully enclose the largest product P that can be safely shipped within the size of the frame 14. By way of example, the material may be chosen to ensure that the product P will remain at least 2 inches away from all sides of the frame 14.

The double fan fold for the hammock 22 shown in FIG. 3 allows the ends of the hammock to be reduced in width to fit through the slot 84. The length of the hammock 22 should be chosen such that the hammock 22 is tensioned moderately tight when the tensor flaps 16 are closed into the hammock tensioning position of FIG. 5*c*. With typical materials, this length of the hammock 22 will ensure that the hammock is loose and easily loaded when the tensor flaps 16 are positioned with the tabs 80 in contact with the end panels 18 as shown in FIG. 5*c*. As pointed out above, a cinching device 50 is preferably used to reduce axial movement of the product P in the hammock 22.

It is not essential that the inner portion 70 be connected at a fold line with the outer portion 72, and two separate pieces can be used in alternate designs. Furthermore, it is not essential in all embodiments to use double ended fasteners 100. A variety of alternate closures, including tape, staples and conventional rivets can be substituted In this case, the tensor flaps 16 can be retained in the hammock tensioning position of FIG. 5*c* by means of a tab formed on the tensor flap 16 (not shown).

Alternately, the tensor flap 16 may be retained in the hammock tensioning position with a bendable strip such as the strip 160 shown in FIG. 9. The strip 160 is held by friction between the two portions 70, 72 of the tensor flaps 16, and can be bent under the end panel 18 to releasably secure the tensor flap 16 in place. The strip 160 may include a metal strip or one or more metal wires, which if desired may be covered with a paper or plastic sheath.

Unpacking Aids

As pointed out above, an untrained person who receives the suspension package 10 may have a tendency to grasp the hammock 22 in an attempt to free the product P. This approach is counterproductive, and may damage the product P.

Figure 7E:
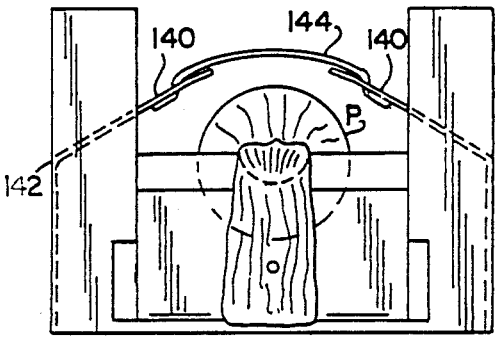
Figure 7A:
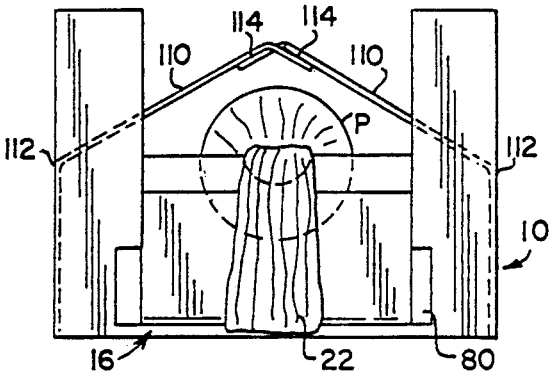
Figure 7F:
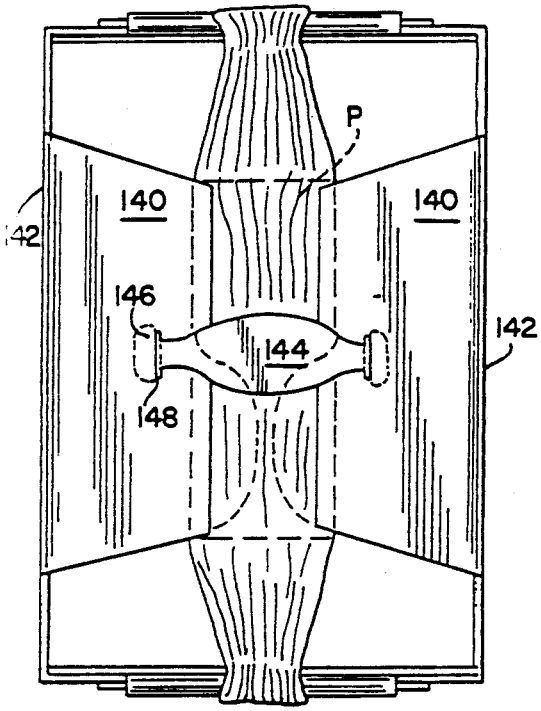
Figure 7B:
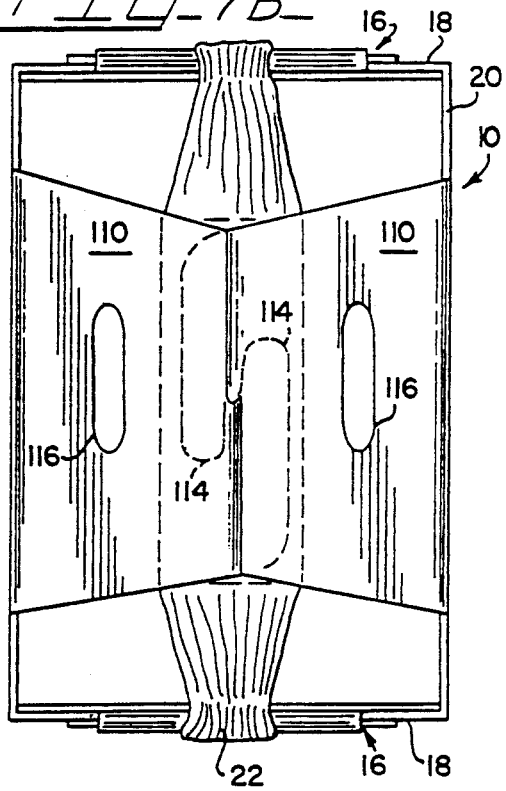

In order to overcome this problem, the frame 14 includes means for spanning the sides of the frame over the hammock to provide graspable surfaces that can be used to lift the frame 14 from the container 12. In this embodiment the spanning means comprises covers 110 which are each integrally formed with a respective side panel 20 and are connected thereto at a fold line 112. Each of the covers 110 defines an interlocking edge 114 and a slot 116. As shown in FIG. 1, the covers 110 may be folded back for access to the product P. However, the covers are interlocked with one another as shown in FIGS. 7*a* and 7*b* before the frame 14 is placed in the container 12, and the recipient therefore sees the interlocked covers 110 when the container 12 is opened. The slots 116 can be used to lift the frame 14 from the container 12 without touching the hammock 22, and the covers 110 are preferably printed with appropriate instructions.

FIGS. *7c* through *7g* illustrate four alternate embodiments of the frame of this invention which provide other types of lifting aids.

In the embodiment of FIG. *7c* the side panels 120 are bent inwardly at fold lines 122 and are secured together at their tops by a tab and opening arrangement.

The embodiment of FIG. *7d* includes a cord or ribbon 130 which is releasably secured between the side panels 132. This cord or ribbon 130 can be used as a handle by the user to lift the frame from the container.

FIGS. *7e* and *7f* show another embodiment which combines certain of the features of the embodiments of FIG. *7c* and *7d*. In the embodiment of FIGS. *7e* and *7f*, the side panels 140 are folded inwardly at fold lines 142 to partially mask the product P The uppermost portions of the side panels 140 are interconnected by a handle 144 which is releasably secured to the side panels 144 by ends 146 which pass through slots 148 in the side panels 140. As best shown in FIG. *7f*, the handle 144 provides a natural lifting point for the frame, and the user is obstructed from grasping the product P.

FIG. *7g* shows another embodiment, which is similar to that of FIG. *7c*. In FIG. *7g* one of the side panels defines a slot 150, and the other defines a handle 152 that fits into the slot 150.

The embodiments of FIGS. *7a–7g* provide a frame which is easily used by the recipient. Even a recipient with no familiarity with suspension packages is naturally directed to lift the frame out of the container without grasping the product P.

Details Of Construction

A wide variety of materials can be used for the container 12, the frame 14 and the hammock 22, and this invention is not limited to any particular choice of materials. Purely by way of illustration and to define the presently preferred embodiment of this invention, the following materials have been found suitable for one application. The frame 14 can be formed of corrugated paper or corrugated board having a Mullen test burst strength of 275 pounds, and the container 12 can be formed of a corrugated paper or corrugated paperboard having a Mullen test burst strength of 200 pounds. If desired, a 3 mil foil facing sheet can be included on one surface of the container 12 to improve shielding such as EMI, RFI, and/or electrostatic discharge shielding. Of course, the color of the frame 14 and the container 12 can be chosen as desired, and both may be either plain or printed. If increased strength is desired a higher strength material such as a 275 pound Mullen test burst strength corrugated panel can be used for the container 12.

As pointed out above, a variety of materials can be used for the hammock 22, including plastic films in various thicknesses such as 3, 5, 7, and 10 mils. Scrim reinforced polyurethane film may be advantageous for some applications. Polyurethane films provide high stretch and recovery, which is particularly advantageous in many applications. The hammock is preferably formed from a clear or transparent film, but other films including colored, printed, and antistatic films can be used if desired. One current preferred material is the film supplied by J. P. Stevens as material number MP 1495, in a 5 mil thickness.

Of course, it should be understood that a wide range of changes and modifications can be made to the preferred embodiments described above. It is therefore intended that the foregoing detailed description be regarded as illustrative rather than limiting, and that it be understood that the it is the following claims, including all equivalents, which are intended to define the scope of this invention.

We claim:

1. In a suspension package of the type comprising a frame having two opposed ends, and a hammock stretched across the two opposed ends of the frame to suspend and protect a product within the frame, the improvement comprising:

at least one brace coupled to the opposed ends to reinforce the ends against movement toward one another, thereby reducing any tendency of the hammock to sag excessively during use of the suspension package;

wherein said at least one brace extends under at least a portion of the product when the hammock is positioned for removing the product from the hammock

2. The invention of claim 1 wherein the at least one brace comprises at least one strut extending generally parallel to the hammock between the opposed ends to reinforce the opposed ends against movement toward one another.

3. In a suspension package of the type comprising a frame having two opposed ends, and a hammock stretched across the two opposed ends of the frame to suspend and protect a product within the frame, the improvement comprising:

means for bracing the opposed ends of the frame from moving towards one another in response to forces applied to the opposed ends by the hammock, thereby reducing any tendency of the hammock to sag in use, said bracing means further comprising means for protecting the product from unintended downward movement out of the frame during loading and unloading of the product into and out of the hammock.

4. The invention of claim 3 wherein the bracing means comprises at least one strut extending between the two opposed ends.

5. The invention of claim 2 or 4 wherein the at least one strut comprises two struts, each positioned on a respective side of the hammock

6. The invention of claim 5 wherein the frame additionally comprises a pair of opposed sides extending between the opposed ends, and wherein each of the struts comprises a flap integral with a respective one of the opposed sides and connected thereto at a fold line.

7. The invention of claim 6 wherein each of the flaps defines with the respective connected side an acute angle such that the flaps reinforce the ends at central portions thereof.

8. The invention of claim 6 wherein the flaps are shaped to maintain the frame in a rectangular shape when the flaps are engaged with the ends.

9. The invention of claim 8 wherein the frame and the flaps are configured to fold flat for storage and shipment prior to use.

10. The invention of claim 7 wherein each of the flaps defines a pair of tabs, and wherein each of the opposed ends defines a pair of slots, each positioned to receive and retain a respective one of the tabs.

11. The invention of claim 2 or 4 wherein the strut is centered beneath the hammock generally parallel to the hammock.

12. The invention of claim 11 wherein the strut is tubular in shape.

13. The invention of claim 1 wherein the invention further comprises: at least one cinching device engaged with the hammock between the product and the frame to restrict movement of the product along the hammock and thereby improve centering of the product in the frame.

14. The invention of claim 13 wherein the at least one cinching device comprises two cinching devices, each positioned on the hammock on a respective side of the product.

15. The invention of claim 13 wherein the cinching device comprises a panel which defines a notch positioned to receive the hammock and to limit lateral spreading thereof.

16. The invention of claim 15 wherein the panel is integrally formed with one of the ends and is connected thereto at a fold line.

17. The invention of claim 16 wherein the notch is defined between a pair of converging edges of the panel.

18. The invention of claim 13 wherein the cinching device comprises directionally selective means for allowing the cinching device to be moved along the hammock toward the product while substantially preventing the cinching device from moving along the hammock away from the product, thereby allowing the cinching device to be snugged up against the product after the product has been placed in the hammock.

19. The invention of claim 18 wherein the cinching device is annular in shape and wherein the directionally selective means comprises an array of teeth extendable toward the hammock and away from the product.

20. The invention of claim 13 wherein each of the cinching devices comprises an elongated member dimensioned to surround the hammock and a latch coupled to the elongated member to secure the elongated member in place around the hammock.

21. The invention of claim 1 wherein the frame is positioned within a container, and wherein the invention further comprises:

means, secured to the sides of the frame, for spanning the sides of the frame over the hammock to provide a surface configured to be grasped by a user to remove the frame from the container without grasping the hammock.

22. The invention of claim 21 wherein the spanning means comprises:

a central portion of each of the sides; and means for releasably securing the central portions together over the hammock.

23. The invention of claim 22 wherein each of the central portions is movable inwardly, toward the hammock, with respect to a remaining portion of the respective side, to a bridging position in which they at least partially span the hammock.

24. The invention of claim 22 wherein the releasably securing means comprises a tension member releasably secured between the central portions over the hammock.

25. The invention of claim 24 wherein the tension member is shaped to define a handle.

26. The invention of claim 22 wherein the releasably securing means comprises interlocking edge portions of the central portions.

* * * * *